US005212343A

United States Patent [19]

Brupbacher et al.

[11] Patent Number: 5,212,343

[45] Date of Patent: May 18, 1993

[54] WATER REACTIVE METHOD WITH DELAYED EXPLOSION

[75] Inventors: John M. Brupbacher, Catonsville; Leontios Christodoulou, Baltimore, both of Md.; James M. Patton, Annandale, Va.; Russell N. Bennett, Baltimore, Md.; Alvin F. Bopp; Larry G. Boxall, both of Catonsville, Md.; William M. Buchta, Ellicott City, Md.

[73] Assignee: Martin Marietta Corporation, Bethesda, Md.

[21] Appl. No.: 573,960

[22] Filed: Aug. 27, 1990

[51] Int. Cl.[5] ..... F42B 3/00; F42B 13/14

[52] U.S. Cl. ..... 102/323; 102/302; 102/364; 149/22; 149/108.2; 42/1.14

[58] Field of Search ..... 149/22, 108.2; 42/1.08, 42/1.14; 102/364, 399, 302, 323

[56] References Cited

U.S. PATENT DOCUMENTS

| | | | |
|---|---|---|---|
| H464 | 5/1988 | Lee et al. | 102/364 |
| 3,111,439 | 11/1963 | Brunauer | 149/92 |
| 3,137,993 | 6/1964 | Tyson, Jr. | 60/35.4 |
| 3,353,349 | 11/1967 | Percival | 60/37 |
| 3,377,955 | 4/1968 | Hodgson | 102/102 |
| 3,388,554 | 6/1968 | Hodgson | 60/217 |
| 3,986,909 | 10/1976 | Macri | 149/19.9 |
| 4,034,497 | 7/1977 | Yanda | 42/1 G |
| 4,188,884 | 2/1980 | White et al. | 102/54 |
| 4,280,409 | 7/1981 | Rozner et al. | 102/364 |
| 4,331,080 | 5/1982 | West et al. | 102/301 |
| 4,432,818 | 2/1984 | Givens | 149/22 |

*Primary Examiner*—Peter A. Nelson

*Attorney, Agent, or Firm*—Gay Chin; Bruce M. Winchell; Alan G. Towner

[57] ABSTRACT

Devices and methods are disclosed for contacting a hot reaction mass with water to initiate an explosive reaction. The reaction mass comprises a ceramic or intermetallic material that is produced by exothermically reacting a mixture of reactive elements. Suitable reaction masses include borides and/or carbides that are formed by reacting a mixture comprising B and/or C in combination with an element selected from Ti, V, Cr, Zr, Nb, Mo, Hf, Ta and W. Additional metals such as Al, Li, Mg, Zn, Cu, Be, Na, K, Ca, Rb, Y, U and Cs may also be present in the reactive mixture. In operation, the hot reaction mass is contacted with water to initiate an explosive water reaction and to produce large volumes of hydrogen containing gas.

15 Claims, 4 Drawing Sheets

WATER REACTIVE METHOD WITH DELAYED EXPLOSION

BACKGROUND OF THE INVENTION

This invention relates to devices and methods for contacting water with a hot reaction mass to produce an explosive reaction.

Conventional chemical explosives are frequently sensitive to heat and impact, and when they burn inadvertently, as in a fire, they generally yield toxic fumes. Consequently, these conventional explosives require special handling and storage precautions.

A phenomenon of considerable industrial importance in recent years is the vapor explosion, often referred to as a thermal or steam explosion. This phenomenon results from the extremely rapid heat transfer from hot liquid (e.g., molten metal) to cold liquid (e.g., water) when the two are contacted together. Sporadic explosions resulting from this phenomenon have been responsible for loss of life and property in industry for a number of years, and efforts have been made to understand the extreme violence of these interactions. It is not presently known exactly how these explosions are initiated. However, resultant effects of these interactions are dramatic, and substantial amounts of energy are released during such explosions.

U.S. Pat. No. 4,280,409 to Rozner et al, which is hereby incorporated by reference, discloses a steam or water vapor explosive device which comprises a metal liner selected from aluminum, magnesium, copper, and brass enclosing a water chamber, with a pyrotechnic material surrounding the liner. The pyrotechnic material is composed of a mixture of powders of nickel, metal oxide, and an aluminum containing component which may be from 50 to 100 weight percent of aluminum and from zero to 50 weight percent of another metal selected from magnesium, zirconium, bismuth, beryllium, boron, tantalum, copper, silver, niobium, or mixtures thereof. A steam or vapor explosion is initiated by the flowing contact of the molten pyrotechnic reaction products and liner with water.

U.S. Statutory Invention Registration No. H464 to Lee et al, which is hereby incorporated by reference, relates to an explosive device comprising a liquid chamber and a pyrotechnic material chamber separated from each other by a fusible metal wall. The material contained within the pyrotechnic chamber comprises a mixture of magnesium nickel alloy hydride and an oxidizer selected from CuO, $Li_2O_2$, and $BaO_2$, while the liquid preferably comprises water. In operation, the pyrotechnic material is ignited, destroying the fusible metal wall and ejecting molten metal into the liquid chamber which results in a violent vapor explosion.

U.S. Pat. No. 4,331,080 to West et al, which is hereby incorporated by reference, discloses a composite explosive comprising conventional explosive material intimately mixed with a mixture of boron and another metal capable of exothermically reacting with boron. The conventional explosive material preferably comprises 30 to 70 weight percent of said composite explosive and may include trinitrotoluene (TNT), cyclotrimethylenetrinitramine (RDX), pentaerythritol tetranitrate (PETN), and/or cyclotetramethylenetetranitramine (HMX). The boron containing component includes a metal such as lithium, titanium, hafnium, zirconium, tantalum, or uranium which reacts exothermically with the boron to form intermetallic particles. Preferably, the boron and reactive metal are provided as granules or pellets which are mixed or encapsulated within the conventional explosive material. In operation, the conventional explosive produces a blast or shock wave and initiates an exothermic reaction of the boron and metal mixture to form a mass or cloud of hot or molten intermetallic particles surrounding the explosion. Thus, the composite explosive embraces the destructive properties of the conventional explosive material and the thermal properties of the intermetallic particles. West et al disclose that the intermetallic particles may interact with the ambient environment to cause burning and cratering. However, the reference does not teach the formation of large volumes of hydrogen containing gas and, in fact, teaches that the formation of gas is undesirable.

U.S. Pat. No. 4,188,884 to White et al, which is hereby incorporated by reference, relates to an underwater explosive device comprising a charge such as lithium which explosively reacts with water, and a high explosive material such as PETN placed in such a manner so as to disperse the lithium charge into the surrounding water. Upon detonation, molten lithium reacts with the surrounding water to produce a hydrogen gas bubble which acts to inflict damage upon underwater structures. The lithium is not heated autogeneously by a chemical reaction, but rather is heated indirectly by the high explosive.

SUMMARY OF THE INVENTION

An object of this invention is to provide a new water reactive device.

Another object of this invention is to provide a water reactive explosive device which is relatively insensitive to impact, friction, shock and elevated temperature, and is less likely to prematurely explode than most organic chemical explosives.

A further object of this invention is to provide an explosive device in which elements react exothermically to form a hot reaction mass which is contacted with water to produce an explosion. The device comprises a container, a reactive mixture within the container, means for initiating an exothermic reaction of the mixture, and means for contacting the reacted mixture with water. Suitable reactive mixtures include elements that are exothermically reactive to form ceramics or intermetallics. Preferred mixtures include boron and/or carbon in combination with metals that are reactive to form borides and carbides such as titanium, vanadium, chromium, zirconium, niobium, molybdenum, hafnium, tantalum and tungsten. In addition, other metals such as aluminum, lithium, copper, zinc, magnesium, beryllium, sodium, potassium, calcium, rubidium, yttrium, uranium and cesium may be included. These additional metals are heated by the exothermic reaction to the molten or gaseous state and, upon contact with water, contribute to the energy of the explosion. A major advantage of the present explosive device is that it is not necessary to carry one of the reactive components i.e., water, which results in volume and weight savings. Thus, a high energy of reaction per unit weight or volume is achieved, since one of the reactants in the water reaction may be taken from the environment. In addition, safety is increased in storage and transportation of the devices because they do not become explosive unless the exothermic reaction is initiated and the subsequent reaction mass is contacted with water. The present explosive device is also more efficient than prior art steam or vapor explosion devices in that substantially all of the materials utilized react with water during the explosion, thereby increasing explosive force. Thus, the reactive elements such as boron and titanium exothermically react to form a hot reaction mass such as $TiB_2$, which in turn exothermically reacts with the surrounding water. Any additional metal that is present, such as aluminum, is heated by the exothermic reaction to the liquid or gaseous state and also exothermically reacts with the surrounding water. Therefore, high efficiency is achieved by a highly exothermic heat producing reaction that yields a hot reaction mass which in turn is chemically reactive with water to form hydrogen containing gas.

Another object of the present invention is to provide a hydrogen generating device in which elements react exothermically to form a reaction mass which is then contacted with water to produce hydrogen containing gas. The hydrogen containing gas may be generated rapidly in large volumes to produce an explosive effect. Alternatively, the gas may be generated more slowly, e.g., for use as a propellant. The hydrogen generating device comprises a container, a reactive mixture within the container, means for initiating an exothermic reaction of the mixture, and means for contacting the reacted mixture with water to produce hydrogen containing gas. The reactive mixture is chosen such that, upon reaction and contact with water, a large volume of hydrogen is produced from a relatively small volume of reactive mixture. Suitable reactive mixtures include elements that are exothermically reactive to form ceramics or intermetallics. Preferred mixtures include boron and/or carbon in combination with boride and carbide forming metals such as titanium, vanadium, chromium, zirconium, niobium, molybdenum, hafnium, tantalum and tungsten. In addition, other metals that are reactive with water at elevated temperatures may be added to the reactive mixture, including aluminum, lithium, copper, zinc, magnesium, beryllium, sodium, potassium, calcium, rubidium, yttrium, uranium and cesium.

A further object of the present invention is to provide a method of producing a water explosion, the method comprising providing a reactive mixture, initiating an exothermic reaction of the reactive mixture, allowing sufficient delay time for most of the mixture to react, and then contacting the reacted mixture with water.

These and other objects and advantages of this invention will become apparent from the following description.

DESCRIPTION OF THE PREFERRED EMBODIMENTS

Figure 1:
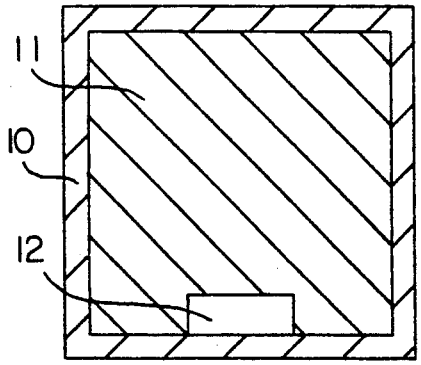
FIG. 1 shows a schematic side cross-sectional view of a water reactive device in which water is provided from the surrounding environment.

One embodiment of the present invention relates to the production of explosive reactions by contacting a hot reaction mass with water. The reaction mass constitutes a ceramic or intermetallic material that is produced by exothermically reacting a mixture of reactive elements. Of the ceramic reaction masses, borides and carbides are preferred. In the formation of borides and/or carbides, at least one reactive element is selected from B and C, and at least one other reactive element is selected from elements that are exothermically reactive with B or C. Preferred reactive elements are those that result in the formation of borides or carbides that exothermically react with water at elevated temperatures to produce large volumes of hydrogen containing gas. Suitable boride and carbide forming elements include Ti, V, Cr, Zr, Nb, Mo, Hf, Ta, W and rare earth elements such as Y, Er and Ru. A particularly preferred reactive mixture comprises B and Ti which react to form $TiB_2$. It is to be noted that while the present disclosure emphasizes the formation of ceramic reaction masses such as borides, the formation of intermetallic reaction masses is also within the scope of the present invention. In the formation of intermetallic reaction masses, the reactive elements are selected such that they undergo a highly exothermic reaction to form an intermetallic material which in turn is reactive with water at elevated temperatures. Suitable intermetallics include aluminides, beryllides, silicides, and intermetallics of chromium with transition metals. Examples of some intermetallics include $Ni_3Al$, NiAl, $Ti_3Al$, TiAl, $TiAl_3$, FeAl, $Nb_3Al$, $Nb_2Al$, $NbAl_3$, $Ti_5Si_3$, $Zr_5Si_3$, $VSi_2$, $BaSi_3$, $NbSi_2$, $Cr_5Si_3$, $Ta_5Si_3$, $TiBe_{12}$, $NbBe_{12}$, $VBe_{12}$ and $YBe_{12}$. Of the aluminides, nickel aluminides and titanium aluminides are particularly suitable.

The reactive elements are typically present in stoichiometric amounts necessary to form ceramics or intermetallics. For instance, the elements may be present in amounts needed to form borides such as $TiB_2$, $ZrB_2$, etc., or carbides such as TiC, VC, etc. However, a stoichiometric excess of either of the reactants may be used, in which case the remaining, unreacted element is heated by the exothermic reaction and may contribute to the subsequent water reaction. Thus, in a reactive mixture containing B and Ti, either the B or Ti may be provided in excess over that required to form $TiB_2$.

In addition to elements that are reactive to form ceramics or intermetallics, other metals may optionally be present within the reactive mixture. For example, in mixtures that are reactive to form borides or carbides, other metals such as Al, Li, Mg, Zn, Cu, Be, Na, K, Ca, Rb, Y, U and Cs may also be present. The additional metal may constitute up to about 80 weight percent of the total reactive mixture, and may typically constitute from about 5 to about 35 weight percent of the mixture. In operation, these metals are heated by the exothermic ceramic or intermetallic forming reaction and contribute to the subsequent water reaction. Metals having a high reactivity with water at elevated temperatures such as Al, Be, B and Ti, are suitable. These metals may be provided alone or may be alloyed with other metals in order to vary such characteristics as thermal conductivity and oxidation of the alloys. For example, aluminum may be used alone or in combination with other metals such as Li, Mg, Zn, etc. Group I and Group II such as Li, Mg and Na may be used. However, it has been found that the Group I and II metals generally do not react with water as energetically and do not generate as much gas as other metals such as Al, Be, B and Ti. Table I shows a comparison of chemical energies and gas evolution for various metals, $TiB_2$ and a conventional explosive (RDX). The calculations are made for one cubic meter of material, with a starting material temperature of 25° C. and a final material temperature of 400° C.

TABLE I

CHEMICAL ENERGIES AND GAS EVOLUTION FOR VARIOUS MATERIALS $M + xH_2O \rightarrow MO_x + xH_2$

| Material | Energy Release ($\times 10^6$ kJ) | $H_2$ Evolution at STP ($m^3$) | Water Vapor at STP ($m^3$) |
|---|---|---|---|
| Al | 36.2 | 3,370 | 13,940 |
| B | 37.1 | 7,270 | 14,290 |
| Be | 57.7 | 4,520 | 22,220 |
| Li | 10.5 | 860 | 4,040 |
| Mg | 20.5 | 1,600 | 7,890 |
| Na | 1.9 | 470 | 730 |
| Ti | 30.5 | 4,210 | 11,740 |
| $TiB_2$ | 25.1 | 7,250 | 9,670 |
| TB100* | 33.6 | 5,640 | 12,940 |
| TBA80** | 34.2 | 5,090 | 13,170 |
| RDX | 10.1 | ~500 | 3,890 |

*1:2 mole ratio of Ti:B powder, calculated at 100 percent density.
**80 weight percent TB100 plus 20 weight percent Al powder, calculated at 100 percent density.

The reactive mixture of the present invention is typically in the form of powders of the individual elements. Thus, for example, powders of B and Ti, or powders of B, Ti and Al, may be blended to form the reactive mixture. Alternatively, the reactive mixture may be provided in the form of alloyed powder. For example, the powder particles may each contain a combination of B and Ti, or B, Ti and Al. The powders may be provided in loose form. However, the powders are preferably compacted to achieve greater efficiency i.e., greater energy release and gas evolution per unit volume. As a general rule, the exothermic reaction of the mixture proceeds at a slower rate as powder density is increased. For example, a reactive powder mixture packed to a density of 50 or 70 percent may react more rapidly than a 90 to 95 percent dense mixture. In the preferred embodiments, the powders are dried and degassed in order to minimize the evolution of unwanted gas during the exothermic reaction.

In accordance with the present invention, initiation of the exothermic reaction of the reactive mixture is achieved by suitable ignition means including electric arc, spark, heated wire, laser, electromagnetic radiation, thermite reaction, chemical reaction, blasting cap, detonator, etc. The reaction is preferably initiated by supplying energy to one or more localized areas of the reactive mixture, e.g., by heating at least one area of the mixture.

Once the exothermic reaction is initiated, sufficient time must be allowed for most of the mixture to react before it is contacted with water. Delay times of greater than about 0.01 second are suitable, with delay times of greater than about 0.1 second being preferred. The delay time may be as long as 100 seconds or more. However, for long delay times care must be taken that the reaction mass does not cool to an undesirable extent before it is contacted with water.

Contacting of the hot reaction mass with water may be achieved by several means, including dispersing the mass outwardly into surrounding water, dispersing the mass into an internal water chamber, or flowing water onto the mass. Several methods may be employed to disperse the reaction mass, including the use of explosive charges, gas pressure, or mechanical means. When an explosive charge is used, it is provided in a relatively small amount, since its purpose is to disperse the reaction mass into water rather than to provide a large overall explosive effect. Thus, the weight of explosive charge used is typically less than about 20 percent of the weight of reactive mixture used. Preferably, the weight of explosive charge is less than about 10 percent of that of the reactive mixture, and is more preferably less than about 5 percent. Expressed as a ratio, the weight of reactive mixture to the weight of explosive is typically greater than about 5:1, preferably greater than about 10:1, and more preferably greater than about 20:1. The geometry of the explosive charge may be selected in order to focus or direct the reaction mass in any desired manner. To better control the directionality of the reaction mass, the explosive material and reactive mixture should preferably occupy distinct volumes rather than being provided as an intimate mixture. A detonator is typically provided for setting-off the explosive charge. The detonator may be activated by an electronic signal that is delayed a predetermined amount of time from the ignition of the reactive mixture, thereby allowing sufficient time for substantially all of the mixture to react. Alternatively, the detonator may be activated by the heat produced by the exothermic reaction of the mixture, in which case the detonator possesses a sensitivity to heat that provides sufficient delay time for the mixture to substantially completely react before the detonator is activated.

As used herein, the term "water" is meant to include liquids that predominantly contain water, including distilled water, tap water and sea water. However, other ingredients may also be present including alcohols, surfactants, antifreezes, and the like. It is noted that the present invention is susceptible to modification whereby other liquids such as fuels, hydrazine, or any other liquid that is reactive with the reaction mass may be substituted for water.

The present invention provides advantages over prior art steam or water vapor explosive devices in that a hot ceramic or intermetallic reaction mass having temperatures on the order of about 1000° to 3000° C. is contacted with water to cause a direct exothermic reaction therewith. For example, hot $TiB_2$ particles may be contacted with water resulting in the following reaction:

$$TiB_2(s)+5H_2O(l)\rightarrow TiO_2(s)+B_2O_3(s)+5H_2(g).$$

As can be seen, large volumes of hydrogen gas are formed by the method of the present invention. In addition, water vapor is formed upon contact of the hot ceramic and/or its hot oxides with water. Prior art steam or water vapor explosive devices, as disclosed in U.S. Pat. No. 4,280,409 discussed previously, are not based upon an exothermic reaction with water and the resultant formation of large volumes of hydrogen gas, but rather rely primarily upon the rapid formation of steam or water vapor resulting from the contact of molten metal with cool water. In contrast, the devices of the present invention operate by a different mechanism, whereby newly formed ceramics or intermetallics having high temperatures are contacted with water to initiate an exothermic reaction, thereby generating large volumes of hydrogen gas. The formation of hydrogen gas is advantageous because it is incondensible in water and is believed to cool down more slowly than water vapor. Furthermore, in oxygen containing environments, the resultant hydrogen can be used for a secondary explosion, forming $H_2O$.

Reference is now made to the drawings wherein like reference characters designate corresponding parts throughout the several figures. FIG. 1 shows a side cross-sectional view of a water reactive device comprising a container 10 having a reactive mixture 11 contained therein. An igniter 12 is provided for initiating an exothermic reaction of the reactive mixture. The igniter may be of the electric arc type, but may also comprise a heated wire, laser, etc. capable of heating a localized area of the reactive mixture. In operation, water surrounds the device. Upon ignition and reaction of the reactive mixture, the resultant hot reaction mass is contacted with the surrounding water. Contact may be achieved by melting the container 10, in which case the container comprises a material such as Al, Mg, etc., having a melting point below the temperature generated by the exothermic reaction. Alternatively, contact may be achieved by rupture of the container once a designated pressure has been reached. Such pressure may be produced by gas generated during the exothermic reaction. For example, the gas may comprise water vapor produced by a small amount of water present within the reaction mixture. Alternatively, the reaction mixture may comprise a small amount of a material such as ammonium nitrate or ammonium perchlorate that thermally decomposes to form gas.

Figure 2:
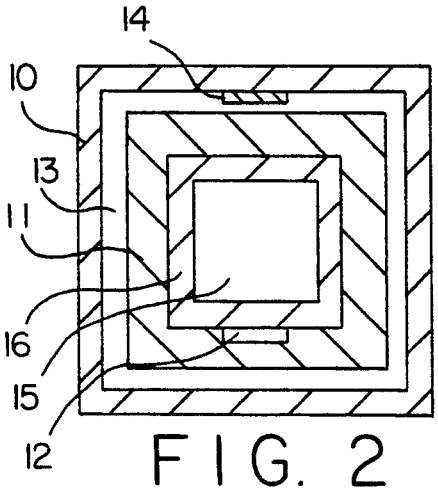
FIG. 2 shows a schematic side cross-sectional view of a water reactive device containing an internal water chamber.

FIG. 2 shows a side cross-sectional view of a water reactive device comprising a container 10 having a reactive mixture 11 contained therein and an igniter 12 in contact with the mixture for initiating a reaction thereof. A layer of explosive material 13 is provided surrounding the reactive mixture 11 and a detonator 14 is provided in contact with the explosive material. A water chamber 15 is provided internal to the reactive mixture, the water chamber 15 being enclosed by a water receptacle 16. In operation, the ignitor 12 initiates an exothermic reaction of the reactive mixture. After sufficient delay time, during which most, if not all, of the mixture reacts, the detonator 14 is activated to cause an explosion of the explosive material 13, forcing the reaction mass through the water receptacle 16 and into the water chamber 15, thereby causing a water reaction. The container 10 and water receptacle 16 may be constructed of any suitable material such as aluminum or steel. The explosive material 13 comprises a conventional explosive such as PETN and is provided in a relatively small amount necessary to force the reaction mass into the water chamber. The detonator may be activated by an electronic signal that is delayed a predetermined amount of time from the ignition of the reactive mixture, or may be activated by the heat produced by the exothermic reaction of the mixture.

Figure 3:
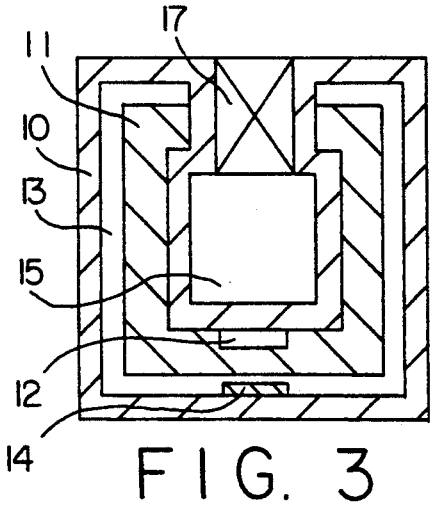
FIG. 3 shows a schematic side cross-sectional view of a water reactive device containing an internal water chamber including means for filling the chamber with water and means for dispersing reactive material into the chamber.

FIG. 3 shows a side cross-sectional view of a water reactive device substantially similar to that of FIG. 2 with the addition of means 17 for filling the water chamber 15 with water. Element 17 may comprise a simple hole through which water may enter the chamber 15, or may comprise a one-way valve, plug, or other conventional device for filling and containing water within the chamber. The device of FIG. 3 has an advantage over that of FIG. 2 in that the device may be stored separately from water and then filled with water just prior to its use. This provides an added layer of safety, since the devices are essentially nonexplosive until the reactive mixture is ignited and brought into the proximity of water.

Figure 4:
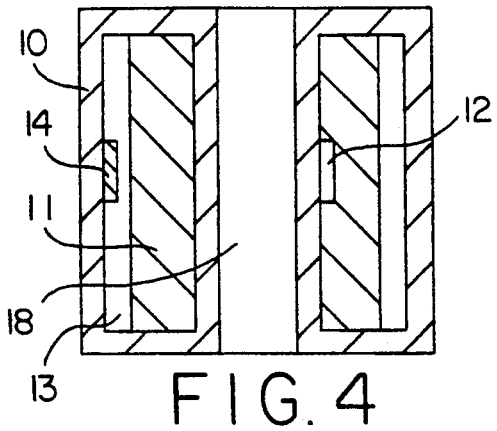
FIG. 4 shows a schematic side cross-sectional view of a generally cylindrical shaped water reactive device including implosion means for dispersing reactive material into water.
Figure 4A:
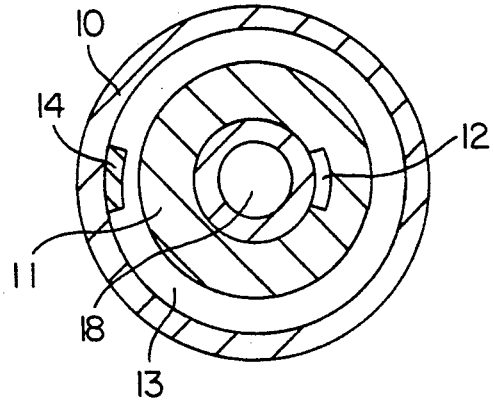
FIG. 4*a* shows a schematic axial cross-sectional view of the water reactive device of FIG. 4.

FIGS. 4 and 4*a* show a side cross-sectional view and an axial cross-sectional view, respectively, of a water reactive device comprising a container 10 having a reactive mixture 11 contained therein and an igniter 12 in contact with the mixture for initiating a reaction thereof. The container is of generally cylindrical shape having a conduit 18 located at its axial center. A layer of explosive material 13 is provided axially surrounding the reactive mixture 11 and a detonator 14 is provided in contact with the explosive material. In operation, the ignitor 12 initiates an exothermic reaction of the reactive mixture. After sufficient delay time, the detonator 14 is activated to cause an explosion of the explosive material 13 which acts to implode the reaction mass into the conduit 18. The conduit may contain water, in which case a water reaction is initiated once the reaction mass enters the conduit. If the conduit does not contain water, the reaction mass implodes into the conduit and then explodes into surrounding water to initiate the water reaction. The explosive material 13 comprises a conventional explosive such as PETN that is provided in a relatively small amount necessary to disperse the reaction mass into water contained within the conduit and/or water surrounding the device.

Figure 5:
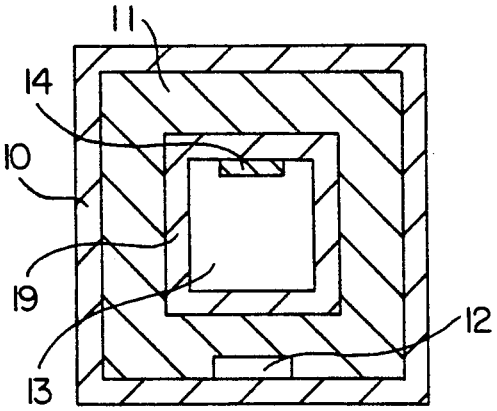
FIG. 5 shows a schematic side cross-sectional view of a water reactive device including explosion means for dispersing reactive material into surrounding water.

FIG. 5 shows a side cross-sectional view of a water reactive device comprising a container 10 having a reactive mixture 11 contained therein and an igniter 12 in contact with the mixture for initiating a reaction thereof. A core of explosive material 13 is provided interior to the reactive mixture 11 and a detonator 14 is provided in contact with the explosive material. A separator 19 is provided between the reactive mixture 11 and the explosive material 13. The separator 19 surrounds the explosive material 13 and insulates the explosive material from the heat generated by the exothermic reaction of the reactive mixture. The separator 19 may be made of aluminum, steel, plastic, or any other suitable material. For increased heat insulation, the separator 19 may comprise a material with low thermal conductivity including commercially available refractory sheets. The device operates in a manner similar to those described previously. Thus, after ignition and substantially complete reaction of the reactive mixture, the explosive material 13 is detonated to thereby disperse the reaction mass into surrounding water.

Figure 6:
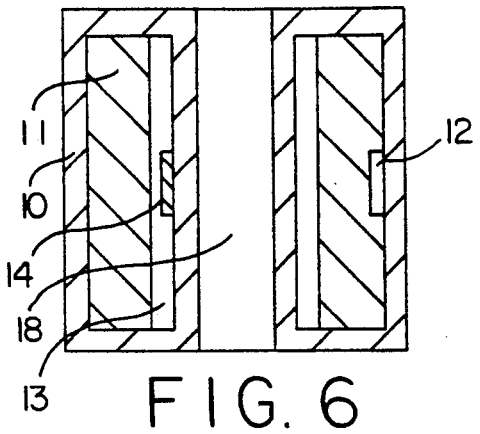
FIG. 6 shows a schematic side cross-sectional view of a generally cylindrical shaped water reactive device including explosion means for dispersing reactive material into surrounding water.
Figure 6A:
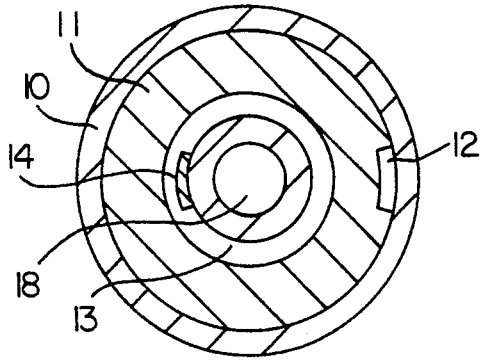
FIG. 6*a* shows a schematic axial cross-sectional view of the water reactive device of FIG. 6.

FIGS. 6 and 6*a* show a side cross-sectional view and an axial cross-sectional view, respectively, of a water reactive device comprising a container 10 having a reactive mixture 11 contained therein and an igniter 12 in contact with the mixture for initiating a reaction thereof. The container is of generally cylindrical shape having a conduit 18 located at its axial center. A layer of explosive material 13 is provided axially interior to the reactive mixture 11 and a detonator 14 is provided in contact with the explosive material. In operation, the ignitor 12 initiates an exothermic reaction of the reactive mixture. After sufficient delay time, the detonator 14 is activated to cause an explosion of the explosive material 13 which acts to disperse the reaction mass into surrounding water to initiate the water reaction.

Figure 7:
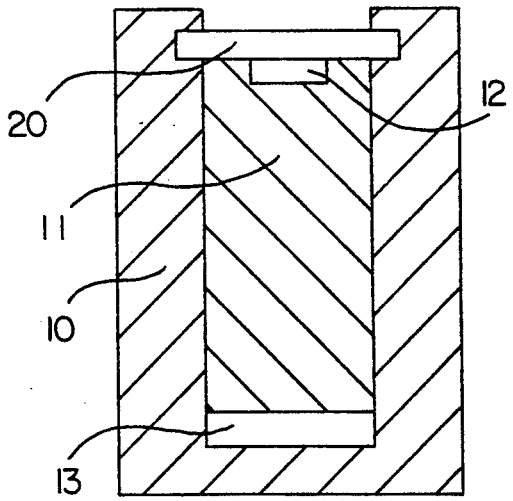
FIG. 7 shows a schematic side cross-sectional view of a water reactive device including means for dispersing reactive material into surrounding water.

FIG. 7 shows a side cross-sectional view of a water reactive device comprising a container 10 having a reactive mixture 11 contained therein and an igniter 12 in contact with the mixture for initiating a reaction thereof. A layer of explosive material 13 is provided in contact with the reactive mixture at one end of the container, while a rupture disk 20 is provided at the other end of the container. In practice, the explosive material may be detonated by the heat generated by the reaction mass, thereby causing the reaction mass to break through the rupture disk and disperse into surrounding water. The explosive material may be replaced with other means for dispersing the reaction mass. For example, wet sand or a container containing a small amount of water may be used, in which case heat given off by the exothermic reaction vaporizes the water, resulting in a build up of pressure that breaks the rupture disk 20 and disperses the reaction mass. Alternatively, the explosive material may be replaced with mechanical means, such as a spring device, for forcibly ejecting the reaction mass into the surrounding water. The rupture disk 20 may be provided in any configuration that allows the reaction mass to break through upon the build up of heat and/or pressure. Thus, the rupture disk 20 may comprise a sheet of material or a notched cap that fractures at a designated pressure.

Figure 8:
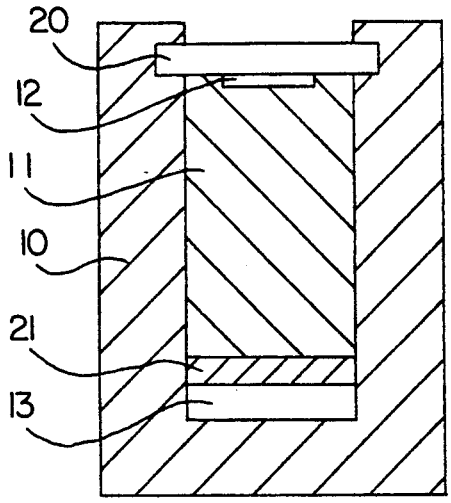
FIG. 8 shows a schematic side cross-sectional view of a water reactive device including means for dispersing reactive material into surrounding water.

FIG. 8 shows a side cross-sectional view of a water reactive device similar to that of FIG. 7, with the addition of an insulation layer 21 provided between the reactive mixture 11 and the explosive material 13. The insulation layer 21 acts to physically separate the explosive material 13 from the reactive mixture 11 and also provides insulation from the heat given off from the reaction of the reactive mixture. Such heat insulation may be useful in delaying detonation of a heat sensitive explosive material until the reactive mixture has substantially completely reacted. If the explosive material is replaced with gas generating means or mechanical means, as discussed in Example 7, the insulation layer 21 may also act as a piston which forcibly ejects the reaction mass through the rupture disk 20 and into the surrounding water.

Figure 9:
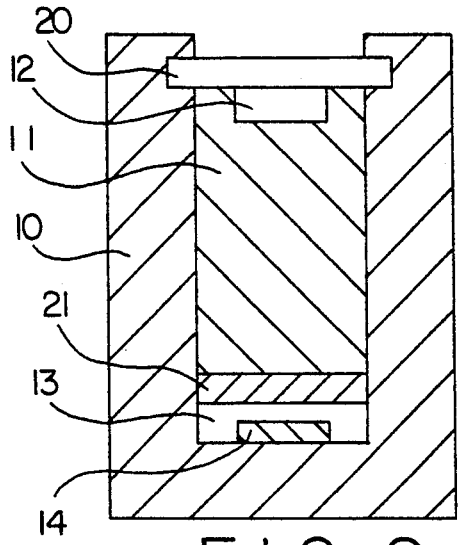
FIG. 9 shows a schematic side cross-sectional view of a water reactive device including means for dispersing reactive material into surrounding water.

FIG. 9 shows a side cross-sectional view of a water reactive device similar to that of FIG. 8, with the addition of a detonator 14 provided in contact with the explosive material 13. In operation, the detonator 14 is activated after a sufficient delay time, during which most of the reactive mixture 11 reacts. The explosive material is provided in sufficient amounts to force the reaction mass through the rupture disk 20 and into the surrounding water. Such explosive materials as PETN are suitable, with DETASHEET ®C manufactured by DuPont, Inc. being a preferred explosive.

Figure 10:
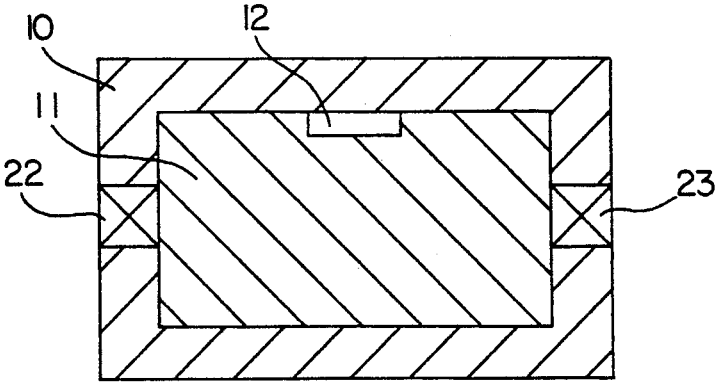
FIG. 10 shows a schematic side cross-sectional view of a water reactive device including means for contacting reactive material with water and means for exhausting the resultant hydrogen containing gas.

FIG. 10 shows a schematic side cross-sectional view of a hydrogen generating device comprising a container 10 having a reactive mixture 11 contained therein and an igniter 12 in contact with the mixture for initiating a reaction thereof. Flow means 22 are provided for flowing water into the container 10 to contact the reaction mass, while exhaust means 23 are provided for exhausting the resultant hydrogen containing gas from the container. The flow means 22 may comprise any suitable means such as a hole or valve through which water may enter the container 10. When a valve is used, it may be controlled by conventional means to vary the rate at which water is introduced into the container, thereby controlling the rate at which hydrogen containing gas is produced. The flow means may also include pressure means for forcing water into the container. The exhaust means 23 may comprise any suitable means for exhausting gas from the container 10, such as a simple hole, nozzle, valve, etc. In operation, an exothermic reaction of the reactive mixture is initiated, then water is introduced through the flow means 22 into the container 10 in a controlled fashion to produce hydrogen containing gas at the desired rate. The hydrogen containing gas may be produced at a constant rate, or may be produced at a variable rate. The time frame over which the gas is generated may range from less than about 0.001 second to greater than 10 minutes. Of course, the duration and volume of gas generation may be varied depending upon the application sought.

The following examples are meant to illustrate the present invention and are not intended to limit the scope thereof.

A reactive mixture comprising 68.88 weight percent titanium powder and 31.12 weight percent boron powder, designated as TB100, was used in each of the following examples. The particle size for these powders was less than 44 microns for titanium and less than 3 microns for boron.

EXAMPLE 1

A test device was constructed using a 4 inch diameter by 10 inch long, schedule 40 iron pipe with a threaded iron cap on the bottom end. Approximately 4 inches of sand, a 0.5 inch layer of fiber insulation material and a 4 inch diameter aluminum disk were placed in the bottom of the pipe. 1,000 grams of TB100 powder having a density of about 2.3 g/cm$^3$ was then placed on top of the aluminum disk. An M-100 electric match from ICI Aerospace, Inc. with a squib containing 2 to 5 grams of a 23:77 weight ratio of a titanium-copper oxide powder mixture was placed approximately 0.5 inches below the upper surface of the TB100 powder. A type K thermocouple was placed at the bottom of the TB100 powder. Epoxy cement was used to seal electrical wires in a stainless steel tubing to provide an electrical circuit through a compression fitting in the pipe wall. A 4 inch diameter rupture disk assembly fitted with a 1,000 psi rupture disk was used to seal the top end of the pipe. The test device was placed in a land test bunker and a 24 volt battery was connected to the electric match to ignite the reactive mixture of TB100 powder. A large fire ball and a large cloud of white smoke was produced approximately 0.5 seconds after ignition of the TB100 powder. The self dispersion of the hot TB100 material resulted when the rupture disk was burst by the pressure generated by the evaporation and/or reaction of sorbed moisture (approximately 1 weight percent in the TB100 powder) during the exothermic formation of titanium diboride. X-ray analysis confirmed the presence of titanium diboride and its oxides in the residue material. A peak temperature greater than 2,000 degrees centigrade was recorded before the thermocouple failed.

EXAMPLE 2

A device similar to that of Example 1 was constructed without the thermocouple and lowered into water on a steel cable to a depth of 15 feet with the rupture disk pointing upwards. Underwater pressure transducer models PCB 138A05 (1-5,000 psi) and PCB 138A10 (1-10,000 psi) were positioned 3 to 14 feet from the test device to monitor the underwater explosion. A 24 volt battery was connected to the electric match to ignite the TB100 powder. An underwater explosion resulted approximately 0.5 seconds after the electric match ignited the TB100 powder and a 7-8 foot high water plume was produced on the surface of the water. Underwater pressure measurements showed an initial shock wave that was longer in duration than shock waves measured for conventional high explosives, followed by a series of bubble pressure pulses. The water plume contained numerous pieces of glowing hot material which detonated the hydrogen gas in the water plume to give a loud air explosion.

EXAMPLE 3

The rupture disk in Example 2 was replaced with a 1,500 psi rupture disk to produce larger underwater and air explosions.

EXAMPLE 4

The TB100 powder in Example 1 was replaced with a reactive mixture of 80 weight percent TB100 plus 20 weight percent aluminum powder, the mixture having a density of about 2.2 g/cm$^3$. The aluminum powder particle size was between 44 and 150 microns. A peak temperature of 1,600 to 1,800 degrees centigrade was recorded for the aluminum containing powder mixture and the air dispersion was less energetic than in Example 1.

EXAMPLE 5

The TB100 powder in Example 2 was replaced with a reactive mixture of 80 weight percent TB100 plus 20 weight percent aluminum powder, the mixture having a density of about 2.2 g/cm$^3$. The aluminum powder particle size was between 44 and 150 microns. A 750 psi rupture disk was used. The underwater and air explosions were less energetic than in Example 2.

EXAMPLE 6

The test device in Example 1 was modified to explosively disperse the hot material. The TB100 powder was vacuum dried at 100 degrees centigrade for 14 hours at a pressure of less than 0.001 torr to remove the sorbed moisture and then sealed in a metal can. The TB100 reactive mixture had a density of about 2.3 g/cm$^3$. Thirty eight grams of high explosive material, DETASHEET®C from DuPont Inc., was placed between the sand and the 0.5 inch layer of insulation material INSTADET®#8 detonator from IRECO, Inc. with a DETAPRIME®UA-6 booster from DuPont, Inc. was used to detonate the dispersion charge. The can of dried TB100 powder was placed on top of the aluminum disk. The rupture disk assembly was replaced with a threaded iron cap. A 3.5 inch diameter groove had been machined one third of the distance through the cap. The delay between the ignition of the TB100 powder and the detonation of the dispersion charge was 1-2 seconds. The air dispersion of the hot material in the land bunker was significantly more energetic than in Example 1. The residue material in the test bunker was reduced in both quantity and average particle size.

EXAMPLE 7

The explosive charge and detonator of Example 6 were replaced with sand. Upon ignition and reaction the reacted TB100 material did not self disperse in the land bunker test.

EXAMPLE 8

The test device in Example 2 was replaced with the device in Example 6. The height and diameter of the water plume resulting from the underwater explosion were doubled. No glowing hot pieces of material were observed in the water plume and there was no air-hydrogen explosion. The shock wave on the water surface and energy of the underwater pressure pulses were greater than Examples 2 and 3.

EXAMPLE 9

The reactive mixture of TB100 powder in Example 8 was replaced with sand. Detonation of the explosive charge did not produce a water plume.

EXAMPLE 10

The test depth in Example 8 was increased from 15 feet to 40 feet. The underwater explosion produced a series of gas bubbles at the water surface instead of a water plume.

EXAMPLE 11

The TB100 powder in Example 10 was replaced with an equal volume of the high explosive TOVEX Blastrite #3 TM from Explosives Technologies International, Inc. A significantly smaller amount of gas compared to Example 10 was discharged from the water surface when the high explosive was detonated at a depth of 40 feet.

EXAMPLE 12

The TB100 powder in Example 10 was replaced with an equal volume of sand. A significantly smaller amount of gas compared to Example 10 was discharged from the water surface when the dispersion charge was detonated at a depth of 40 feet.

EXAMPLE 13

The TB100 powder in Example 10 was replaced with a reactive mixture of 80 weight percent TB100 plus 20 weight percent aluminum powder, the mixture having a density of about 2.2 g/cm$^3$. The aluminum powder particle size was between 44 and 150 microns. The underwater explosion produced a series of gas bubbles at the water surface.

EXAMPLE 14

The TB100 powder in Example 10 was replaced with a reactive mixture of 80 weight percent TB100 plus 20 weight percent magnesium powder, the mixture having a density of about 2.2 g/cm$^3$. The magnesium powder particle size was less than 150 microns. The underwater explosion produced a series of gas bubbles at the water surface.

EXAMPLE 15

The TB100 powder in Example 10 was replaced with a reactive mixture of 80 weight percent TB100 plus 20 weight percent an aluminum alloy powder comprising 5 weight percent Mg, 2 weight percent Li, 0.5 weight percent Zr and the balance Al, the mixture having a density of about 2.2 g/cm$^3$. The alloy powder particle size was less than 150 microns. The underwater explosion produced a series of gas bubbles at the water surface.

EXAMPLE 16

The TB100 powder in Example 10 was replaced with a reactive mixture of 80 weight percent TB100 plus 20 weight percent of 1:1 mole ratio aluminum-lithium powder, the mixture having a density of about 2.2 g/cm$^3$. The aluminum-lithium powder particle size was less than 150 microns. The underwater explosion produced a series of gas bubbles at the water surface.

EXAMPLE 17

The test device in Example 10 was scaled up by increasing the pipe diameter to 12 inches, the weight of TB100 to 15,000 grams, the weight of DETASHEET® explosive to 905 grams and the top cap was replaced with a 0.25 inch thick steel plate. The underwater explosion produced a shock wave on the water surface, multiple oscillations in the water level and a large water plume. Underwater pressure measurements showed an initial shock wave that was longer in duration than shock waves measured for conventional explosives, followed by a series of 3 bubble pressure pulses. The gas bubble emerging from the water surface was estimated to be approximately 10 to 12 feet in diameter compared to a theoretical calculated maximum bubble diameter of 12 feet.

EXAMPLE 18

905 grams of DETASHEET® was detonated at a depth of 40 feet to produce only a small amount of gas bubbles at the water surface.

EXAMPLE 19

Example 8 was repeated with a sealed 5 gallon steel drum filled with air suspended horizontally 6 feet above the device. The side wall of the drum was crushed inward from 4 directions and ruptured in several locations by the gas bubble from the underwater explosion.

EXAMPLE 20

A hydrogen generating test device was constructed using a 2.5 inch diameter by 10 inch long, schedule 80 steel pipe with a threaded steel cap on the bottom end. A 0.25 inch diameter copper tube from a high pressure water pump was connected to the test device through a compression fitting in the bottom cap. The pump could inject water into the test device at a constant rate of 450 cm$^3$ per minute up to a pressure of 20,000 psi. Putty sealant was used to provide a temporary seal over the water inlet in the bottom cap. A 0.25 inch thick sleeve of fiber insulation was placed in the device to reduce heat loss through the pipe sidewall. A 1,500 psi pressure relief valve was installed in the sidewall of the device approximately 2 inches below the top end of the pipe. TB100 powder was isostatically pressed into a rod approximately 0.75 inches in diameter and then cut into 0.1 to 0.3 inch thick disk shaped pieces. The TB100 pieces were vacuum dried at 100° C. for 14 hours at a pressure of less than 0.001 torr to remove the sorbed moisture. Two hundred grams of the dried compressed TB100 pieces were placed in the bottom of the test device. An electric match and squib similar to that in Example 1 were installed in the device. The test device was then sealed with a threaded steel cap on the top end of the pipe. The assembled device was lowered into water to a depth of 6 feet with the bottom end pointing downwards. The open end of a 0.25 inch diameter copper tube connected to the pressure relief valve was positioned approximately 10 inches below the water surface to facilitate a photographic record of the gas evolution from the test device. A 24 volt battery was connected to the electric match to ignite the pieces of TB100 material. The water injection pump was started approximately 2 seconds after ignition of the TB100 material. A 4 second burst of white smoke followed by a steady stream of colorless gas bubbles were discharged from the test device through the 1,500 psi relief valve. The discharge of white smoke began approximately 0.3 seconds after the ignition of the TB100 material. The color and density of the white smoke was similar to that observed in the land test bunker in Example 1. The discharge of colorless gas bubbles began approximately 2.5 seconds after the water injection pump was started and continued for approximately 25 seconds. The calculated time required to inject enough water into the test device to react with all of the hot ceramic material is 35 seconds. X-ray analysis of the residue remaining in the test device confirmed the presence of titanium and boron oxides plus titanium diboride.

It is to be noted that the above description of the present invention is susceptible to considerable modification, change and adaptation by those skilled in the art, and that such modifications, changes and adaptations are intended to be considered within the scope of the present invention, which is set forth by the appended claims.

We claim:

1. A method of producing a water explosion comprising the steps of:
   a. providing a reactive mixture comprising elements that are exothermically reactive to form a ceramic or intermetallic material;
   b. initiating an exothermic reaction of the reactive mixture;
   c. allowing sufficient delay time for most of the reactive mixture to react to attain an elevated temperature; and
   d. contacting the elevated temperature reacted mixture with water to produce an explosion.

2. A method according to claim 1, wherein the reactive mixture comprises at least one element selected from the group consisting of B and C, and at least one element selected from the group consisting of Ti, V, Cr, Zr, Nb, Mo, Hf, Ta and W.

3. A method according to claim 2, wherein the reactive mixture also contains up to about 80 weight percent of a metal selected from Y the group consisting of Al, Li, Mg, Zn, Cu, Be, Na, K, Ca, Rb, Y, U, Cs, and combinations thereof.

4. A method according to claim 3, wherein the metal comprises from about 5 to about 35 weight percent of the reactive mixture.

5. A method according to claim 1, wherein the reactive mixture comprises B and Ti.

6. A method according to claim 5, wherein the B and Ti are present in substantially stoichiometric proportion to form $TiB_2$.

7. A method according to claim 5, wherein the B or Ti is present in stoichiometric excess.

8. A method according to claim 5, wherein the reactive mixture also contains up to about 80 weight percent of a metal selected from the group consisting of Al, Li, Mg, Zn, Cu, Be, Na, K, Ca, Rb, Y, U, Cs, and combinations thereof.

9. A method according to claim 1, wherein the reactive mixture comprises a substantially homogeneous mixture of powders of the elements.

10. A method according to claim 1, wherein the exothermic reaction is initiated by heating at least one localized area of the reactive mixture.

11. A method according to claim 1, wherein the exothermic reaction is initiated by electric arc, spark, heated wire, laser, electromagnetic radiation, thermite reaction, chemical reaction, blasting cap, or detonator.

12. A method according to claim 1, wherein the delay time is greater than about 0.01 second.

13. A method according to claim 1, wherein the delay time is from about 0.1 to about 100 seconds.

14. A method according to claim 1, wherein contacting of the reacted mixture with water is accomplished by explosive means.

15. A method according to claim 1, wherein contacting of the reacted mixture with water is accomplished by dispersing the mixture into surrounding water.

* * * * *